US006418839B1

(12) United States Patent
Keller et al.

(10) Patent No.: US 6,418,839 B1
(45) Date of Patent: Jul. 16, 2002

(54) DETECTION SYSTEM FOR A PRESS PISTON GUIDING SYSTEM

(75) Inventors: Daniel L. Keller, New Bremen; Jill M. Bornhorst, Minster, both of OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 09/483,395

(22) Filed: Jan. 14, 2000

(51) Int. Cl.[7] ..... B30B 15/24
(52) U.S. Cl. ..... 100/35; 100/43; 100/46
(58) Field of Search ..... 100/43, 46, 35, 100/258 R, 258 A, 299, 99; 72/20.2, 21.2, 31.11; 173/20, 21

(56) References Cited

U.S. PATENT DOCUMENTS

| | | | | |
|---|---|---|---|---|
| 1,996,063 A | | 4/1935 | Corkran | 324/698 |
| 3,227,951 A | | 1/1966 | Dykaar | 324/671 |
| 3,956,604 A | | 5/1976 | Larker et al. | 100/99 |
| 4,059,794 A | * | 11/1977 | Furness et al. | 72/21 |
| 4,345,203 A | | 8/1982 | Vermeiren et al. | 324/671 |
| 4,443,754 A | | 4/1984 | King | 324/671 |
| 4,480,538 A | * | 11/1984 | Yoshida | 100/43 |
| 5,113,756 A | * | 5/1992 | Fujii | 100/99 |
| 5,372,033 A | | 12/1994 | Jackson et al. | 70/53.05 |
| 5,414,940 A | * | 5/1995 | Sturdevant | 33/559 |
| 5,493,959 A | * | 2/1996 | Yagi et al. | 100/43 |
| 5,559,428 A | | 9/1996 | Li et al. | 324/71.5 |
| 6,128,987 A | * | 10/2000 | Nakagawa et al. | 100/269.14 |

* cited by examiner

*Primary Examiner*—Stephen F. Gerrity
*Assistant Examiner*—Louis Huynh
(74) *Attorney, Agent, or Firm*—Randall J. Knuth

(57) ABSTRACT

A detection system is installed into a press piston guiding area for detecting if the piston guiding system has lost its requisite clearance. The detector is installed in a typical press in such a way that when the negatively grounded press piston touches the detector, it discharges the electrical potential between the detector and the piston. Upon contact, a signaling device stops the press, and a fault is indicated. In an alternative embodiment, the detector senses an eddy current when in close proximity to the piston.

17 Claims, 2 Drawing Sheets

DETECTION SYSTEM FOR A PRESS PISTON GUIDING SYSTEM

BACKGROUND OF THE INVENTION

1. Field of the Invention

The present invention relates to mechanical presses, and more particularly, to a detector and detection method for determining when a drive piston in a press has deviated from a preferred reciprocating drive path, the detector thereby preventing undue damage to the press guiding system and the drive piston when sufficient clearance is lost.

2. Description of the Related Art

Mechanical presses are frequently used in forging, forming, bending, blanking, or otherwise shaping material such as metal. Mechanical presses generally include a stationary bed and a vertically reciprocal ram driven by a piston. A die is mounted to the stationary bed, and a complimentary die is mounted to the reciprocating ram. When driven together, the two dies form the material to the shape of the dies. The formed material is subsequently removed from the press, and a new sheet of material inserted.

The accurate guiding of the press slide during reciprocation thereof is highly important because if the dies mounted on the press bed and the press slide are not held in proper registration, improper workpieces are produced and damage to the press parts and dies could potentially result. Furthermore, it is not always the case that the dies of the aforesaid nature can be mounted in a press in such a manner as to prevent any non-uniform loading on the press slide, and when such loading occurs, a press slide may be subjected to rather large forces in the side to side or fore and aft directions, thereby tending to thrust the slide laterally in one direction or the other.

Under circumstances of this nature, guide surfaces of the press slide and press frame wear excessively, and improperly formed workpieces can result. Typically, it is when this clearance is lost or reduced below tolerance that the drive piston's lubricating oil film is squeezed out, and the piston consequently begins to damage the guide members. If these types of problems go undetected, a loss of production can result in addition to substantial downtime for the press.

SUMMARY OF THE INVENTION

Having the foregoing in mind, it is a primary object of this invention to detect when a drive piston and guide member loses the clearance between them, and prevent further damage to both press components. By recognizing such a fault and immediately ceasing operation of the press, press downtime is reduced, as well as the cost of repair and replacement parts.

The present invention is directed to a detection system for detecting when a drive piston contacts the guide member. The invention includes a contact element having an electrical potential of between positive 12 and 24 VDC, and a negative ground that is connected to the drive piston, such that when the drive piston deviates from its preferred drive path, it makes contact with the contact element, thereby decreasing the electrical potential in the contact element. The invention further comprises a responder that responds to the decrease in the electrical potential by indicating the fault to the press operator or press controller and simultaneously shutting the press down.

The invention provides for the contact element to be located in the lower part of the guide member. During normal operation, a drive piston passes over the contact element without coming into contact with it. However, when the press is improperly adjusted, or the guiding member or clearance has become ineffective or lost, the drive piston comes in contact with the guide, and subsequently contacts the contact element.

In an alternative embodiment, the contact element is replaced with an eddy current sensor, which does not require direct contact by the piston, but rather senses when the piston is near enough to create an eddy current.

In the preferred embodiment of the invention, the drive piston is at ground electric potential. The contact element holds a positive 12 to 24 VDC electrical potential. As long as the voltage remains constant at this contact element, the press can operate normally. However, when the piston deviates from its preferred path, and touches the detector, the positive 12 to 24 VDC will suddenly decrease, signaling to the responder to indicate a fault and shut down the press operation.

In the invention, an electrical characteristic is applied to a driven member of the press, and a detection element with an electrical characteristic is secured to the guide member of the press, such that the detection element experiences a detectable change in its electrical characteristic when it is engaged with the driven member. A responder subsequently responds to the change in electrical characteristic by signaling a fault and to cease operation of the press.

In an alternative embodiment of the invention, an eddy current sensor element is secured to the guide/member of the press, the eddy current sensor element signaling to a responder when the driven member deviates from its reciprocation path.

The invention can also be stated as a method comprising the steps of providing a ground electrical characteristic to a drive piston, and providing a contract element mounted to a guide member for contacting the drive piston when the drive piston is horizontally translating during press operation.

It is an advantage of this electrical system there are no complicated sensors or moving parts of the detectors that can fault or break.

It is a further advantage of the system that the operator can be immediately notified of undesirable operation. Prior to this invention, operation of the press in this loss of clearance condition could sometimes go undetected until problems would occur in the tooling or a seal would prematurely fail.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
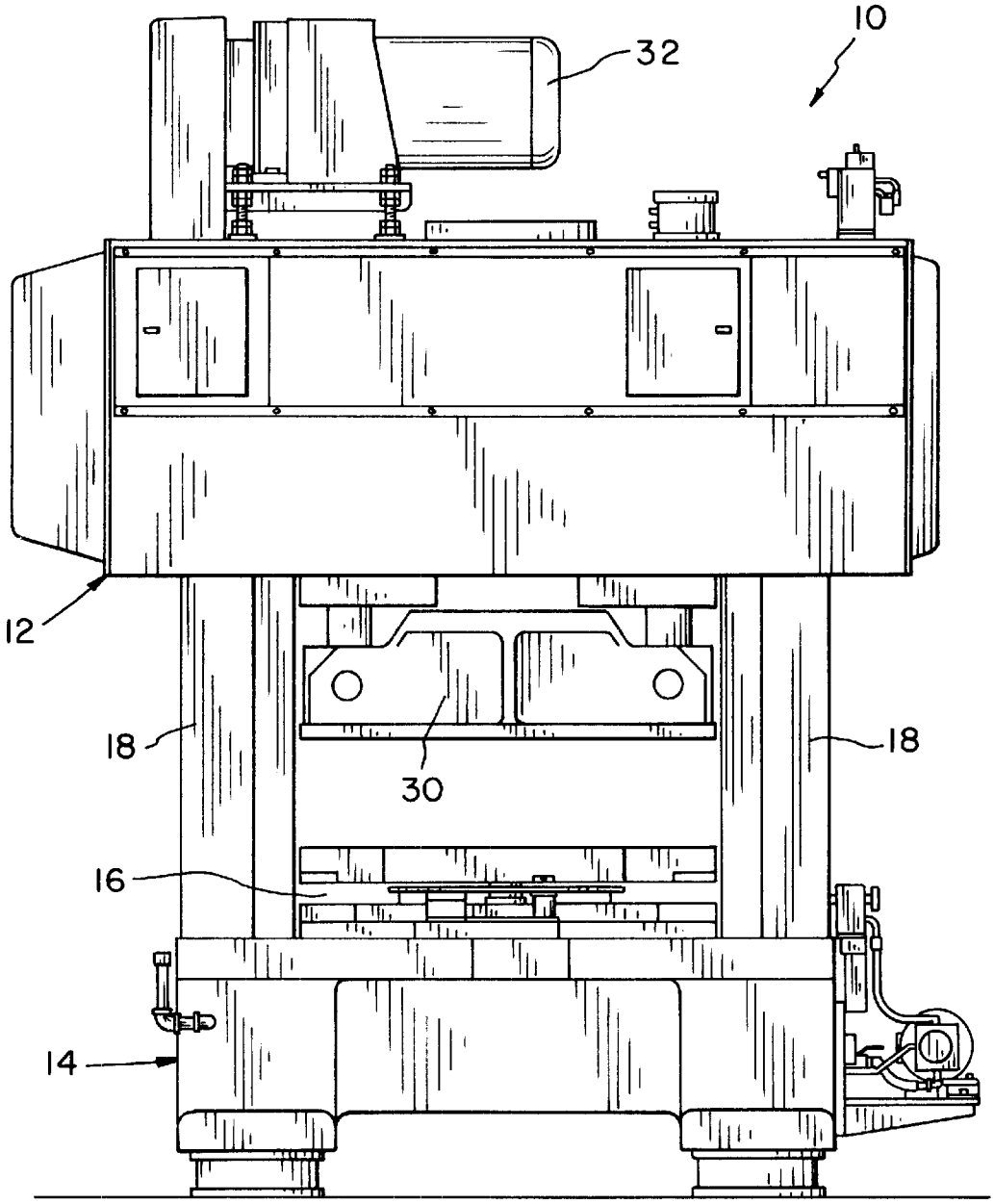
FIG. 1 is a front elevational view of a mechanical press incorporating the detection system of the present invention.

Referring now to the drawings and particularly to FIG. 1, a typical mechanical press 10 comprises a crown portion 12, a bed portion 14 having a bolster assembly 16 connected thereto and uprights 18 connecting crown portion 12 with bed portion 14. Uprights 18 are connected to or integral with the underside of crown 12 and the upper side of bed 14.

A slide 30 is disposed between press uprights 18 as shown in FIG. 1. Slide 30 reciprocates within press 10 by the action of main drive motor 32 attached to the top portion of crown 12. Connected to main drive motor 32 by means of a belt (not shown) and a hydraulic combination clutch/brake (not shown) is drive piston 34 (see FIG. 2), which drives slide 30.

Figure 2:
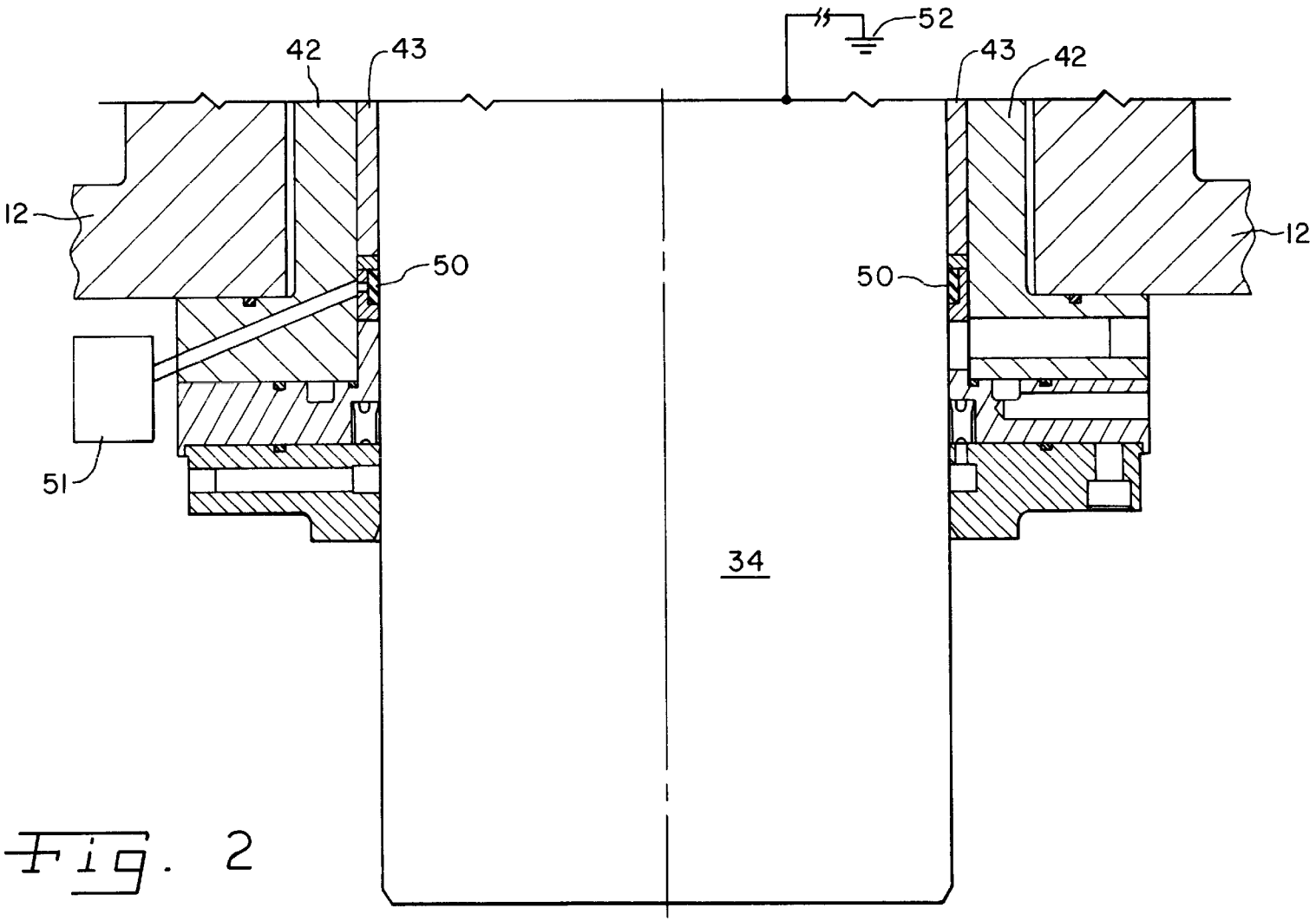
FIG. 2 is a sectional view of the detection system as it would be applied within the crown of the press.

As shown in FIG. 2, crown 12 is engaged with piston housing 42, which in turn is engaged with guide 43. According to the invention, contact element 50 is free from intimately contacting piston 34 during normal operation.

In the preferred embodiment of the invention, an improperly adjusted press or an ineffective guide 43 is sensed by contact element 50 when piston 34 deviates from its preferred reciprocating drive path such that it engages with contact element 50.

Contact element 50 senses the engagement of piston 34 in the following manner. According to the invention, contact element 50 is provided with an electrical potential, falling substantially within a range of positive 12 to 24 VDC. During normal press operation, the electrical potential provided to contact element 50 is maintained at a nearly constant value. Piston 34 is coupled to an electrical ground 52, such that piston 34 is capable of diminishing an electrical potential upon contact. Consequently, if piston 34 were to engage with contact element 50, the electrical potential that was previously maintained at contact element 50 is caused to decrease to an electrical potential value of 0.

The preferred embodiment further comprises a responding device 51 coupled to contact element 50 for indicating to an operator when a fault has occurred, and signaling to cease operation of press 10.

In an alternative embodiment of the invention, contact element 50 is comprised of an eddy current detector, the eddy current detector having the capability of detecting the magnetic presence of piston 34 without the engagement of piston 34 with contact element 50. In the alternative embodiment, piston 34 creates minimal to no eddy current in contact element 50 until piston 34 deviates from its preferred reciprocating drive path. On that deviation, contact element 50 senses an eddy current, and simultaneously indicates a fault to the operator and ceases operation of the press. A preset eddy current limit may be utilized to set the sensitivity of element 50, thereby controlling the clearance value that will trigger responding device 51.

The invention can also be described as a method comprising the steps of providing a ground electrical characteristic to drive piston 34, providing contact element 50 that is mounted to guide 43 in the lower portion of crown 12, and providing an indicator for indicating when the contact element 50 has engaged piston 34, signaling a fault.

The preferred embodiment of the invention permits operation of press 10 in the following manner. Piston 34 reciprocates vertically, driven by drive motor 32, such that piston 34 travels parallel to uprights 18 between crown portion 12 and bed portion 14. Guide 43 is integrally coupled to the lower portion of crown 12, with piston housing 42 disposed between guide 43 and crown 12. During operation, drive piston 34 is substantially prevented from horizontal translation by guides 43. However, when guides 43 fail to prevent horizontal translation of piston 34, thereby allowing piston 34 to deviate from its preferred reciprocating drive path, creating a potential for the damaged press parts, contact element 50 loses clearance with piston 34 such that contact element 50 engages with piston 34.

Upon engagement, contact element 50 discharges the electrical potential that was maintained during normal press operation, due to the fact that electrically conductive piston 34 is coupled to ground 52. Contact element 50 then indicates a fault, and the responder responds to that fault by ceasing the operation of the press 10, and indicating a fault to the operator.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mechanical press comprising:

a crown;

a housing connected to said crown;

a guide member connected to said housing;

a driven member slidable and guided by said guide member in said housing; and a translation-sensing apparatus, said translation-sensing apparatus including:

a means for providing a first electrical characteristic to said driven member;

a detection element secured to said guide member at a lower portion of said crown, said detection element having a second electrical characteristic of different amplitude from said first electrical characteristic, said detection element experiencing a change in said second electrical characteristic when said driven member deviates from a substantial vertical reciprocation path causing said detection element to operably engage at least a portion of said driven member; and a responding device for responding to said change in said second electrical characteristic.

2. The mechanical press of claim 1, wherein said detection element is in proximal relation to a lower portion of said guide member.

3. The mechanical press of claim 1, wherein said means of providing a first electrical characteristic to said driven member is an electric ground coupled to said driven member.

4. The mechanical press of claim 1, wherein said second electrical characteristic of said detection element is an electrical potential falling substantially within a range of 12 to24 VDC.

5. The mechanical press of claim 1, wherein said responding device indicates to an operator when said detection element experiences a change in said second electrical characteristic.

6. The mechanical press of claim 1, wherein said responding device signals to cease operation of said mechanical press when said detection element experiences a change in said second electrical characteristic.

7. A press having an apparatus for determining when a drive piston in said press has deviated from a preferred reciprocating drive path, said press comprising:

a crown;

a housing connected to said crown;

a guide member connected to said housing;

a driven piston slidable and guided by said guide member in said housing; and an apparatus for determining when said drive piston has deviated from a preferred reciprocating drive path, said apparatus including:

a contact element having an electrical potential falling substantially within a range of 12 to 24 VDC, said contact element mounted to said guide member at a lower portion of said crown;

an electrical ground coupled with said drive piston, said electrical ground causing a decrease in said electrical potential of said contact element when said drive piston engages at least a portion of said contact element; and a responding device for responding to said decrease in said electrical potential.

8. The press of claim 7, wherein said responding device indicates when said contact element experiences a decrease in said electrical potential.

9. The apparatus of claim 7, wherein said responding device signals to cease operation of said press when said contact element experiences a decrease in said electrical potential.

10. A mechanical press comprising:

a crown;

a housing connected to said crown;

a guide member connected to said housing;

a driven member slidable and guided by said guide member in said housing; and a translation-sensing apparatus, said translation-sensing apparatus including:

an eddy current sensor element secured to said guide member at a lower portion of said crown, said sensor element sensing an eddy current when said driven member deviates from a substantial vertical reciprocation path causing said sensor element to sense the energizing of an eddy current due to a proximity of said driven member; and a responding device for responding to said change in said sensor element by signaling a fault.

11. The mechanical press of claim 10, wherein said driven member is a piston.

12. The mechanical press of claim 11, wherein said sensor element is in proximal relation to a lower portion of said guide member.

13. The mechanical press of claim 10, wherein said responding device indicates to an operator when said sensor element experiences said fault.

14. The mechanical press of claim 10, wherein said responding device signals to cease operation of said mechanical press when said sensor element experiences said fault.

15. A method of detecting horizontal translation of a substantially vertically reciprocating drive piston in a press, comprising the steps of:

providing a press having a crown, a housing connected to said crown, a guide member connected to said housing, and a drive piston slidable and guided by said guide member;

providing a ground electrical characteristic to said drive piston;

providing a contact element having an electrical potential, said contact element mounted to said guide member at a lower portion of said crown for contacting said drive piston when said drive piston is horizontally translating during press operation, thereby reducing said electrical potential of said contact element; and detecting the reduced electrical potential of said contact element and signaling a fault.

16. The method of claim 15, further comprising the step of providing a responding device for indicating to an operator when said electrical potential of said contact element is reduced and a fault is signaled.

17. The method of claim 15, further comprising the step of ceasing operation of said press when said electrical potential of said contact element is reduced and a fault is signaled.

* * * * *